United States Patent [19]

Sternberg

[11] 3,967,118

[45] June 29, 1976

[54] METHOD AND APPARATUS FOR CHARGING A BUNDLE OF FILAMENTS

[75] Inventor: Ernest M. Sternberg, Chapel Hill, N.C.

[73] Assignee: Monsanto Company, St. Louis, Mo.

[22] Filed: Apr. 29, 1975

[21] Appl. No.: 572,800

[52] U.S. Cl. ..... 250/325; 264/121; 317/262 A

[51] Int. Cl.[2] ..... H01T 19/04

[58] Field of Search ..... 250/324, 325; 317/262 A, 262 R; 264/121

[56] References Cited

UNITED STATES PATENTS 2,939,956 6/1960 Parks ..... 250/324

3,689,608 9/1972 Hollberg et al. ..... 264/121

*Primary Examiner*—Alfred E. Smith
*Assistant Examiner*—T. N. Grigsby
*Attorney, Agent, or Firm*—Robert L. Broad, Jr.

[57] ABSTRACT

Method and apparatus for charging filaments moving along a path wherein the filaments are passed across the face of a target electrode in a sheet of moving air and a plurality of corona discharge electrodes arranged in a row extending in the direction of filament travel apply an electric charge to the filaments to separate them. The corona discharge electrodes are positioned along the filament path between the point where the filaments impinge the target electrode and the point where the air stream velocity has decreased to about the velocity of the filaments.

11 Claims, 5 Drawing Figures

METHOD AND APPARATUS FOR CHARGING A BUNDLE OF FILAMENTS

BACKGROUND OF THE INVENTION

1. Field of the Invention

This invention relates to methods and apparatus for charging moving filaments.

2. Description of the Prior Art

It is known to make nonwoven fabrics from staple or continuous filaments by passing the filaments through air nozzles to drive the filaments onto a foraminous belt where a nonwoven web is formed as the belt moves past the air nozzles. The web formed on the belt is subsequently bonded in a conventional manner to increase the strength and enhance other properties of the nonwoven web. In order to obtain nonwoven webs of highest quality the filaments being applied to the foraminous belt should be separated from each other prior to contact with the belt. It is known that separation of the filaments can be achieved by use of triboelectricity or by the use of a corona discharge system wherein a high voltage is used to establish an electric field through which the filaments pass.

U.S. Pat. No. 3,163,753, among other patents, discloses a process for charging filaments being fed to a web laydown zone wherein the filaments are pulled under tension in a wide single-filament layer across a target electrode through an electric field which is established by a plurality of corona discharge electrodes spaced laterally across the layer, i.e., the corona discharge electrodes are positioned in a row extending perpendicular to the direction of travel of the filaments. This electrode arrangement is necessary to charge all of the filaments in the layer.

U.S. Pat. No. 3,689,608 is typical of a number of patents which show apparatus wherein plexifilaments from a spinnerette are projected onto a deflector which opens the plexifilaments into a wide configuration. The spread plexifilament then falls past a target electrode where an electric charge is applied. To charge the spread plexifilament, an array of discharge electrodes positioned in a circle concentric with the deflector is used. Since the plexifilament seems to spread more or less radially from the deflector, this arrangement amounts to a lateral positioning of the electrodes across the path of travel of the plexifilament, such as in U.S. Pat. No. 3,163,753.

One of the major problems encountered in making nonwoven fabrics of the type described is the problem of fabric uniformity. For example, filaments which stick together or are laid into the nonwoven fabric too close to other filaments can easily give the fabric a ropy appearance which will make the fabric unsalable. In the present invention a very high charge is imparted to each of the filaments to insure good filament separation.

SUMMARY OF THE INVENTION

This invention provides a process and apparatus for applying a high electric charge to a plurality of filaments being advanced to a web forming zone, the charging of the filaments being achieved by advancing the filaments over a target electrode in a sheet of air and applying a charge to the filaments by utilizing at least two corona discharge electrodes so positioned that the moving filaments in the air sheet first pass through the electric field created by one of the corona discharge electrodes and then pass through the electric field created by the other corona discharge electrode. The corona discharge electrodes are positioned at points along the filament path between the point where the filaments first impinge the target electrode and the point at which the air sheet velocity has decreased to about the velocity of the filaments.

DETAILED DESCRIPTION OF THE INVENTION

Figure 2:
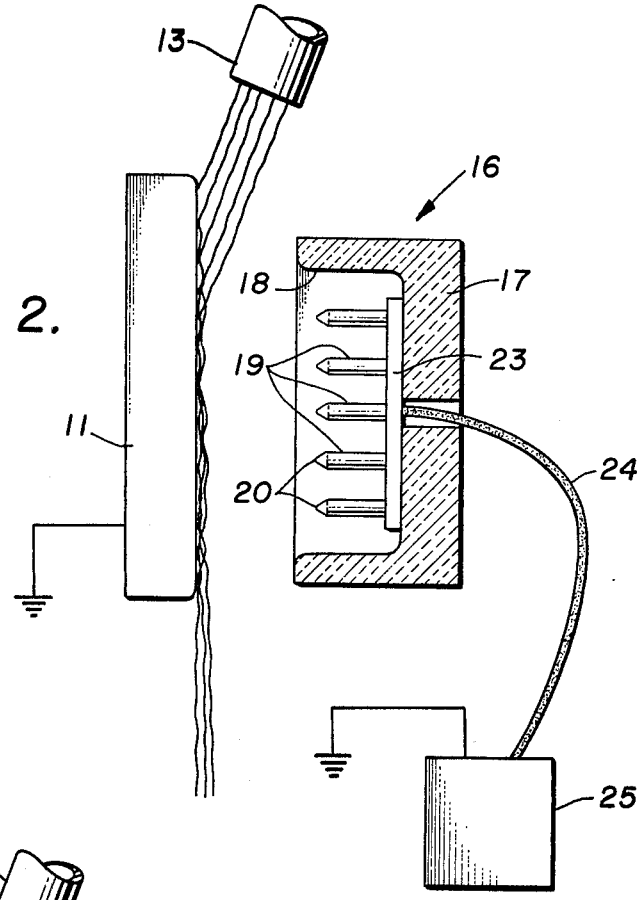
FIG. 2 is a side view of one embodiment of the apparatus of the present invention with portions broken away to show the positioning of the corona discharge electrodes relative to the moving filaments and the target electrode.
Figure 1:
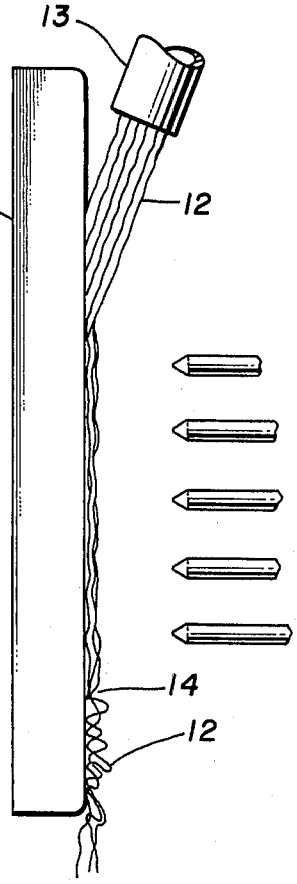
FIG. 1 is a side view showing the path followed by filaments moving across a flat plate in a stream of air.
Figure 3:
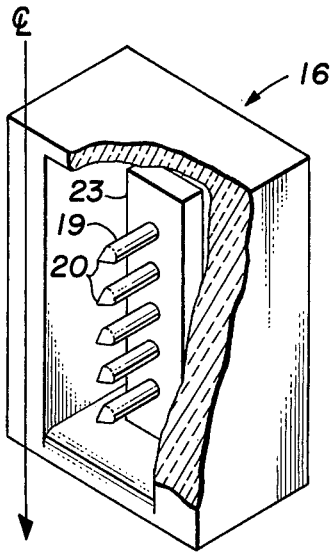
FIG. 3 is a perspective view showing the positioning of the corona discharge pins of this invention relative to the centerline of the filament path.

FIG. 1, which illustrates the principles of this invention, shows the path of filaments 12 passed downward across the face of a flat plate 11 in a high velocity stream of air, the filaments and the air being forwarded into impingement with the plate 11 by an air nozzle 13. When the air stream strikes the plate 11 it spreads and flows down the plate under high-velocity, low-pressure conditions, carrying the entrained filaments with it. The higher pressure surrounding air maintains the filaments in close proximity to the plate without the use of any significant tension on the filaments. Thus, the air flows along the plate in the form of a thin sheet or layer, with the filaments being dispersed across the sheet.

As the air flows and spreads down the surface of the plate the velocity of the air stream will drop. This decrease in air stream velocity is caused by friction between the plate and the air, entrainment of surrounding air and the fact that the cross sectional area of the air stream increases along its path. At some point on the face of the plate 11 the air stream velocity will have decreased to about the velocity of the filaments. Below this point, which is indicated by reference numberal 14 in FIG. 1, the charged filaments may readily cling to the surface of the plate 11 or may easily fail to leave the plate 11 at a uniform rate. This point, where the air velocity and the filament velocity is the same, might be referred to as the "filament cling point". In this invention, the filaments are charged by a plurality of corona discharge electrodes arranged in a row along the direction of filament travel and positioned between the point where the filaments first impinge the plate 11 and the filament cling point.

The filament velocity through the attenuator and across the target electrode can be calculated by dividing the volume of polymer forced through each spinnerette hole in a given time interval by the cross sectional area of the filament at the web formation zone, the cross sectional area of the filaments remaining constant from the target electrode to the web formation zone. Instruments are available for measuring the velocity of the air both at the exit of the attenuator and at points on the face of the target electrode.

If the air and filament velocities at the point of impingement on the target electrode are known and if the angle at which the air stream diverges on the target electrode is known, a rough approximation of the point of equal filament and air velocity can be made without actual measurement. For example, if the air speed at the point of impingement is five times the filament speed, the air velocity and filament velocity will be approximately equal at that point where the air stream has diverged to the point where it is five times as wide as at the point of impingement. Knowing the angle at which the air stream diverges on the target electrode, this point can readily be located.

In the preferred embodiment of the invention the lower or downstream edge of the target electrode is positioned above the point where filament and air velocities are equal, so that the air velocity at the lower edge of the target electrode is greater than the filament velocity at that point. Thus, the target electrode terminates upstream of what would otherwise be the filament cling point.

A charging electrode 16 positioned on the opposite side of the filaments 12 from the target electrode 11 establishes a high intensity electric field through which the moving filaments pass. The charging electrode 16 is made up of a block of insulating material 17 having a recess 18 in which are positioned a plurality of corona discharge electrodes 19. The corona discharge electrodes 19 take the form of cylindrical pins positioned as shown and having sharp tips 20, the sharp tips serving to create a corona discharge at the ends of the pins 19.

The pins 19 are secured to a conductive metal plate 23 which is connected by a wire 24 to one side of a DC voltage source 25 of high potential. The other side of the voltage source 25 is connected through ground to the target electrode 11 so that a high intensity electric field is established between the pins 19 and the target electrode 11.

The pins 19 are positioned in a row extending in the direction of travel of the filaments 12 so that the filaments pass the pins 19 in succession. In other words, a given point on one of the filaments 12 will pass the pins 19 one after the other as the filament moves across the target electrode. Thus, the filaments 12 pass through not one but several electric fields, one after the other.

For purposes of locating the electric fields, a line normal to the target electrode and extending through one of the pins 19 may be considered to be the axis of the electric field associated with that pin. The pins 19 are so located that the axes of the electric fields are positioned between the area where the air stream first impinges the target electrode and the filament cling point. Thus, the electric fields may be said to be positioned along the path of the filaments between the area where the air stream impinges the target electrode and the point where air and filament velocities are equal.

The air nozzle 13 may be a filament attenuator or any other type of gas driven nozzle capable of forwarding filaments. The nozzle is so positioned that the filaments and air stream impinge the flat face of the target electrode at an angle of 0° to 60°, preferably 0° to about 20°. The air stream, flowing at a high velocity, will flatten and flow across the target electrode in the form of a thin sheet, even when the impingement angle is 0°. When the angle between the air stream and the face of the target electrode is 0°, impingement takes place in the sense that the air stream clings to the face of the target electrode. This effect is well known.

The charging of a filament bundle as it is being spread into a fan configuration is disclosed and claimed in copending application Ser. No. 583,275, filed Apr. 30, 1975, for "Method and Apparatus For Forwarding and Charging a Bundle of Filaments" in the name of Ernest M. Sternberg.

If the electric field is measured at the target electrode along the path of the filaments the measuring instrument may not indicate separate fields, since the electric fields are not isolated from each other but are contiguous to and reinforce each other. However, it can be considered that the fields are separate or that there is a plurality of fields in the sense that the electric field at the target electrode emanates from a plurality of points or locations arranged along a line parallel to the filament path.

Figure 4:
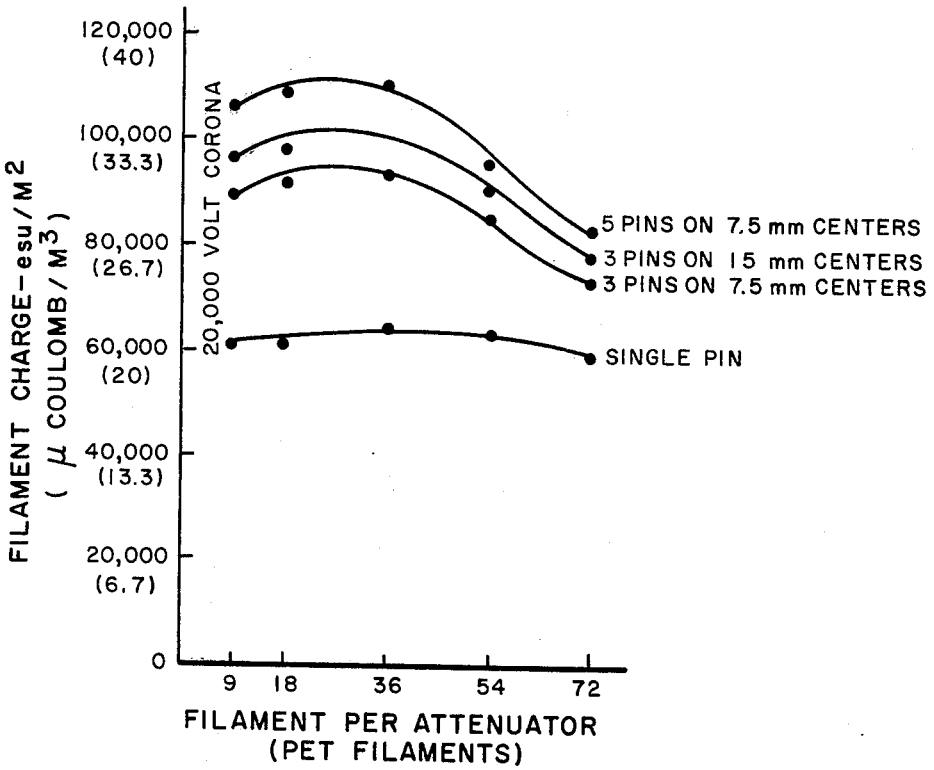
FIG. 4 is a graph showing filament charge plotted against number of filaments for various numbers of corona discharge pins positioned at various distances from each other along the path of the filaments, the filaments in this case being polyethylene terephthalate.
Figure 5:
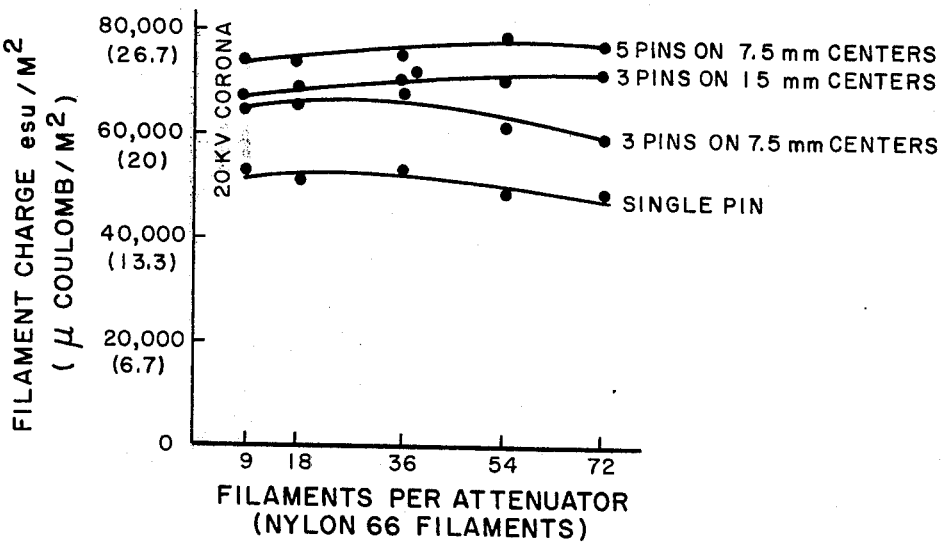
FIG. 5 is a graph showing filament charge plotted against number of filaments for various numbers of corona discharge pins positioned at various distances from each other along the filament path, the filaments in this case being nylon 66.

It has been found that significantly higher filament charges can be achieved by passing the filaments through several electric fields in succession under the proper conditions. For example, FIGS. 4 and 5 show the filament charge applied by a single pin as compared to the filament charge applied by several pins at different spacings along the path of the filaments. The charge levels are shown in these graphs in terms of electrostatic units per square meter (esu/$M^2$) and microcoulombs per square meter (MC/$M^2$). MC/$M^2$ can be converted to esu/$M^2$ by multiplying by the constant $3 \times 10^3$.

FIG. 4 shows the charge applied to polyethylene terephthalate filaments having a denier varying from about 3.8 to 4.7 dpf, with the tips of the corona discharge pins 19 being spaced from the target electrode a distance of about 13 mm. The voltage applied across the electrodes 11 and 16 was 20 kv with the negative side of the voltage being applied to the pins 19. FIG. 4 shows that the maximum charge obtained on the filaments utilizing a single corona discharge pin was slightly above 20 MC/$M^2$, whereas the use of three or more pins in a row charged the filaments to levels of 25 MC/$M^2$ and above.

This figure shows that when five pins are used on a spacing of 7.5 mm and the number of filaments being passed through the charging zone is about 18 to about 36, the charge on the filaments is in the vicinity of about 37 MC/$M^2$. These very high charge levels insure that the filaments will be adequately separated from each other to enhance uniformity of the final product.

FIG. 5 shows the filament charge per square meter obtained on nylon 66 filaments with the use of a single corona discharge pin contrasted with the use of pins at various spacings along the path of the filaments. The filaments used in obtaining the data for this graph varied in denier from about 2.6 to about 2.9 dpf. The voltage applied to the electrodes was 20 kv with the pins 19 being connected to the negative side of the voltage source 25. The spacing between the target electrode 11 and the tips 20 of the pins 19 was about 13 mm. This figure shows that the charge obtained using a single corona discharge pin was below 20 MC/$M^2$ whereas the use of several pins in a row and at different spacings gave filament charges varying from about 20 MC/$M^2$ to about 26 MC/$M^2$.

What is claimed is:

1. The method of forwarding and charging filaments comprising a. forwarding the filaments across the face of a target electrode in a stream of air, said stream of air having a velocity sufficient to form an air sheet on the face of the electrode, and b. applying an electric field to the filaments in the air sheet to charge said filaments, wherein said electric field is generated from a plurality of locations arranged along a line extending in the direction of filament travel.

2. The method of claim 1 wherein the velocity of the air sheet at the downstream edge of the target electrode is greater than the filament velocity.

3. The method of claim 1 wherein the electric field is generated by a plurality of corona discharge pins positioned adjacent to the air sheet and arranged in a row extending in the direction of filament travel.

4. The method of claim 1 wherein the air stream impinges the face of the target electrode at an angle of 0° to 60°.

5. The method of claim 4 wherein the air stream impinges the target electrode at an angle of 0° to 20°.

6. The method of forwarding and charging filaments, comprising a. forwarding the filaments across the face of a target electrode in a stream of air, said stream of air having a velocity sufficient to form an air sheet on the face of the electrode, said air stream impinging the target electrode at an angle of 0° to 20°, and b. charging the filaments by applying a plurality of electric fields to the filaments in the air stream, said electric fields being arranged in a row extending in the direction of filament travel, said electric fields being positioned along the path of the filaments between the point where the air stream impinges the target electrode and the filament cling point.

7. Apparatus for forwarding and charging filaments, comprising a. a target electrode, b. means for forwarding a plurality of filaments in a sheet of air across a face of the target electrode, and c. a corona discharge system adjacent to the target electrode for applying an electric field to the filament in the air sheet, said corona discharge system being adapted to generate said electric field from a plurality of locations arranged in a row extending in the direction of filament travel.

8. The apparatus of claim 7 wherein the corona discharge system comprises a plurality of pins arranged in a row extending in the direction of filament travel.

9. The apparatus of claim 8 wherein the face of the target electrode is a flat surface.

10. Apparatus for forwarding and charging filaments, comprising a. a target electrode, b. an air nozzle positioned to direct a plurality of filaments entrained in an air stream into impingement with a face of the target electrode at an angle of 0° to 60° with said face to form an air sheet on the face of the electrode, c. a plurality of corona discharge pins positioned adjacent to said air sheet and arranged in a row extending in the direction of travel of said filaments, and d. a power supply connected to the target electrode and the corona discharge pins.

11. The apparatus of claim 10 wherein the air nozzle is so positioned that the air stream impinges the face of the target electrode at an angle of 0° to 20°.

* * * * *